United States Patent [19]

Brauner et al.

[11] 4,062,524

[45] Dec. 13, 1977

[54] APPARATUS FOR THE STATIC MIXING OF FLUID STREAMS

[75] Inventors: Dieter Brauner, Solingen-Wald; Hans-Joachim Kaluza, Cologne; Edgar Muschelknautz, Leverkusen, all of Germany

[73] Assignee: Bayer Aktiengesellschaft, Leverkusen, Germany

[21] Appl. No.: 717,073

[22] Filed: Aug. 24, 1976

Related U.S. Application Data

[63] Continuation of Ser. No. 474,836, May 30, 1974, abandoned.

[30] Foreign Application Priority Data

June 6, 1973 Germany ..... 2328795

[51] Int. Cl.[2] ..... B01F 15/02

[52] U.S. Cl. ..... 366/340; 138/37

[58] Field of Search ..... 259/4 R, 4 AB, 4 A, 259/4 AC, 18, 36, 150, 180, 193, 6–10, 19, 37; 222/564, 459; 165/109; 138/38, 42, 43

[56] References Cited

U.S. PATENT DOCUMENTS

| | | | |
|---|---|---|---|
| 2,949,934 | 8/1960 | Schrenk | 138/42 X |
| 3,406,947 | 10/1968 | Harder | 138/42 X |
| 3,995,541 | 12/1976 | Coyle | 222/564 |

FOREIGN PATENT DOCUMENTS

| | | | |
|---|---|---|---|
| 1,462,566 | 11/1966 | France | 138/42 |

*Primary Examiner*—Robert W. Jenkins
*Attorney, Agent, or Firm*—Burgess, Dinklage & Sprung

[57] ABSTRACT

A pipe which contains pairs of comb-like plates which are arranged so that the webs of one plate extend crosswise through the slots of the other and which is used for the static mixing of streams of fluid.

17 Claims, 19 Drawing Figures

APPARATUS FOR THE STATIC MIXING OF FLUID STREAMS

This is a continuation of application Ser. No. 474,836, filed May 30, 1974, now abandoned.

This invention relates to an apparatus for the static mixing of streams of fluid, consisting of a pipe of any cross-section, preferably circular, in which mixing elements are inserted.

Apart from impeller mixers, of which numerous variations are known, so-called static mixers have recently been increasingly used. Their advantage is that they have no moving parts and therefore require no driving means. They are in particular suitable for continuously operating plants, in which they function as continuous-flow mixers. One known mixer of this type comprises a pipe in which curved blade elements are arranged which alternately deflect the stream to the right and to the left. These blade-like elements are set at an angle to each other. A very powerful mixing effect is thereby obtained with minimum pressure loss. One disadvantage of this mixer, however, is its excessive length and for this reason it cannot be used wherever desired.

Another mixing apparatus comprises layers of parallel, obliquely toothed metal sheets which are in contact with each other and form flow channels such that the longitudinal axes of the flow channels of adjacent layers are inclined at an angle to each other. Although this mixing apparatus is quite short, it is subject to a high pressure loss.

Lastly, a mixing apparatus is known which comprises several storeys arranged concentrically about a core, each storey having spiral webs running parallel to each other, and the webs of adjacent storeys extending crosswise to each other so that the channels formed are open to each other at the points of intersection. At these points of intersection, there is a partial exchange of material from one channel to another. An efficient mixing effect is thereby achieved. The pressure loss of this apparatus is relatively high. Furthermore, the mixing body is mounted to be rotatable about the axis of the housing.

Thus we have on the one hand static mixers which are subject to only a slight pressure loss but are too long and on the other hand static mixers which are short but have an excessively high pressure loss.

It is an object of this invention to provide an apparatus for the static mixing of streams of fluids such as gases or liquids or more highly vicous substances, which are short in design and not subject to excessively high pressure loss and yet ensure efficient homogenisation. In addition, the apparatus and its mixing elements should be simple and easy to manufacture. The apparatus should also be suitable for carrying out known chemical or physical reactions for which a mixing effect is required.

According to this invention, the problem is reduced or substantially solved by providing mixing insert which comprises at least two plates provided with webs defining slots therebetween the webs of one plate extend crosswise through the slots of at least one other plate which is set at an angle to the first plate.

Because of the oblique positioning of the plates, the oncoming stream of fluid is divided by the webs into partial streams the production of which is staggered in time and place, and the partial streams are again subdivided by the line of intersection of the plates. At the back of the webs there is a flow gradient in the transverse direction which produces efficient exchange of the partial stream. Since the subdivision of the partial streams occurs at staggered points in time and space, there also results a homogenisation in the direction of flow, which is superimposed by radial components of flow. Beyond the line of intersection of the pairs of plates, the partial streams are again subdivided, this time in the reverse sequence of time and space. Due to the transverse mixing process, the flow approximates closely to the profile of a so-called plug flow so that a narrow spectrum of dwelling times can be achieved, which is advantageous for many reactions. The inclination of the plates to the direction of oncoming flow and to the wall of the pipe may also be multi-dimensional, additional mixing effects being thereby achieved.

According to a particular embodiment of the invention, the mixing insert comprises a plurality of pairs of plates arranged in two rows in such a way that the webs of at least two plates of one row extend through the slots of at least one plate in the other row.

This results in several lines of intersection at which further subdivision of the partial streams takes place.

The plates of each row are preferably arranged parallel to each other. This arrangement does not reduce the mixing effect but makes it possible to achieve rational manufacture of the plates.

According to a particularly advantageous embodiment, a plurality of mixing inserts is provided and the webs of the pairs of plates of the mixing inserts are staggered to each other in the angular direction, for example by 90° C. If an angular displacement of 90° is selected, the resulting apparatus is particularly short because the plates of the various pairs or the plates of the external pairs of adjacent mixing inserts can then be pushed very far into the gaps between the pairs of plates of the adjacent insert. The angular displacement of the mixing inserts arranged in a row results in a spatial subdivision of the partial streams produced by the webs. In this design, powerful mixing effects are obtained when only a few mixing inserts are arranged behind one another. According to another preferred embodiment of the apparatus according to the invention, the webs of the plates taper conically or stepwise. The width of the slots changes accordingly, with the result that the mixing effect in the longitudinal direction can be increased. Radial flow components are thereby produced, especially if this arrangement is used in conjunction with mixing inserts which are staggered in the angular direction, and these radial flow components can produce further mixing effects.

The plates are preferably in the form of combs and have elliptical circumferences. This design forms the basis of a rational manufacturing process, especially for mixing inserts used in pipes of small diameters, because the slots can be cut into a circular section and the plates can then be sliced off obliquely by sawing through the resulting grooved circular section. The desired plates with elliptical circumference are thereby obtained. The cutting angle should preferably be chosen to coincide with the angle at which the plate is set into the wall of the pipe because, in that case, the circumferential surface of the plate fits snugly against the wall of the pipe if the external diameter of the round section used is the same as the internal diameter of the pipe. If exceptionally thin plates are desired, these may advantageously be punched out of sheet metal. It goes without saying that other methods of manufacturing the mixing inserts are also suitable, for example welding processes may be used for constructing large mixing inserts. The plates may, for example, also be constructed that the webs are fixed to a closed ring. The webs and slots are preferably arranged parallel to the major axis of the plates. This is another advantage from the manufacturing point of view.

According to another embodiment of the apparatus according to the invention, it is advantageous, for the purpose of increasing the mixing effect, to align the webs and slots at an angle to the major axis of the plate. Additional mixing effects are thereby achieved.

For certain purposes it may be advantageous to align the webs and slots of the plate so that they converge towards a point. Additional mixing effects are thereby obtained, especially if several mixing inserts staggered in the angular direction are used, because the partial streams then assume different forms from those obtained with parallel webs and slots. In this case, however, the webs must have a certain elasticity in order to enable the webs of one plate to be pushed into the slots of the other. Additional mixing effects are also obtained by using curved plates.

According to a particular embodiment, the cross-sections of the webs have a particular form, for example they may be triangular, drop-shaped or elliptical. Special flow effects are produced, for example, if an edge of a web of triangular section is set at an angle against or even towards the direction of flow, the main effect thereby achieved being more efficient mixing in the transverse direction.

If it is desired to vary the flow velocity of the fluid from the centre of the pipe to the wall, it is advantageous to use plates in which the webs or slots vary in width. The flow is then displaced either towards the centre or towards the periphery, depending on whether the slots are wider or narrower towards the inside or the outside.

The various possible variations of the apparatus according to the invention provide the designer with a great deal of scope to optimise the apparatus for a particular purpose. In particular, the mixing inserts can be built up from variously formed plates, or variously formed mixing inserts comprising identical plates can be arranged behind one another in a suitable sequence. In this way, it is also possible to adjust the mixing inserts or plates to the flow velocity and viscosity of the fluid and, in the case of reactions, they can be adjusted to the required time of stay in individual sections of the apparatus, etc.. The pipe and, optionally, also the mixing inserts may be adapted to be heated or cooled.

Various embodiments of the apparatus according to the invention are illustrated purely diagrammatically in a drawing and described below.

In the drawing,

FIG. 1 represents a side view of one embodiment of the apparatus according to the invention, showing a section through the pipe containing a mixing insert, FIG. 2 represents the example shown in FIG. 1 with the section through the pipe in plan view, FIGS. 3 to 13 show various examples of the plates used for the mixing insert, FIGS. 14 to 18 show various examples of the apparatus with different examples of the arrangements of the mixing inserts or plates and FIG. 19 shows the example of FIG. 14, in the form of a pipe bend.

In all the Figures, similar parts are indicated by the same unit numerals preceded by the numeral of the Figure except that in FIG. 2 the same reference numerals have been used as in FIG. 1.

In FIGS. 1 and 2, the apparatus comprises a pipe 11 in which a mixing insert 12 is installed. This mixing insert 12 consists of two plates 13 and 13' which are in the form of combs comprising webs 14, 14' and slots 15, 15'. The two plates 13 and 13' are inserted into one another so that the slots 14 of plate 13 extend through the slots 15' of plate 13'. The plates 13 and 13' thereby make an angle with each other and both are also set at an angle to the direction of flow, They have elliptical circumferences and therefore make all-round contact with the inside of the pipe 11.

In FIG. 3, plates 33 and 33' have webs 34, 34' arranged parallel to their major axes. The slots 35 and 35' are in the same way arranged parallel to the major axes. Their width corresponds with the width of the webs 34, 34'.

In FIG. 4, the webs 44, 44' and slots 45, 45' of the plates 43, 43' are arranged parallel to each other but obliquely to the major axes of the plates.

The plates 53, 53', shown in FIG. 5 have webs 54, 54' tapering in the form of cones and conversely conical slots 55, 55' conforming to them.

In FIG. 6, the webs 64, 64' of the plates 63, 63' decrease in width stepwise and conforming to this arrangement the slots 65, 65' decrease in width in the opposite direction.

In FIG. 7, the webs 74, 74' and slots 75, 75' of the plates 73, 73' are so arranged that the webs and slots of each plate 73, 73' converge towards a common point F.

Figure 10:
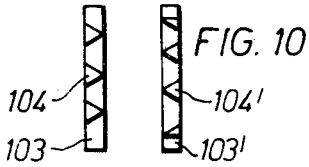
Figure 11:
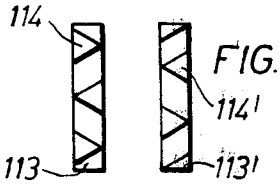

FIG. 10 and 11 show two pairs of plates 103, 103' and 113, 113' in an end on view directed vertically on to the tips of the webs 104, 104' and 114, 114'. The webs 104, 104' and 114, 114' are triangular in cross-section. FIGS. 10 and 11 show various forms of webs.

Figure 12:
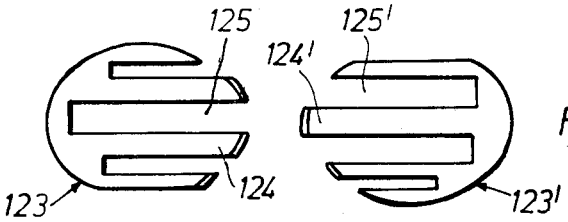

In FIG. 12, the plates 123, 123' have broad webs 124, 124' and wide slots 125, 125' at the centre while the outer webs 124, 124' and outer slots 125, 125' are narrower.

Figure 13:
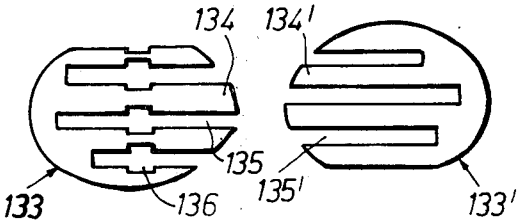

In plates 133, 133' shown in FIG. 13, the webs 134, 134' are broader than the slots 135, 135'. The webs 134 of the plate 133 therefore have grooves 136 into which the webs 134' of the plate 133 can be inserted. The grooves 136 are set at the angle which the two plates 133, 133' are required to enclose.

Figure 1:
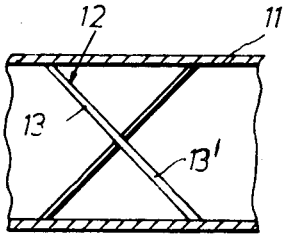
Figure 2:
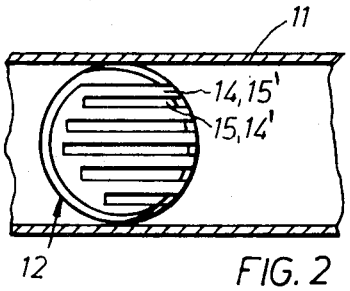
Figure 14:
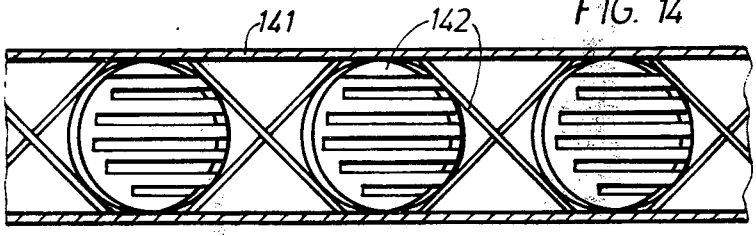

FIG. 14 shows several mixing inserts 142 arranged in a row inside the pipe 141 in which they are displaced by 90° from each other. The design of the individual mixing inserts is similar to that shown in FIGS. 1 and 2.

Figure 3:
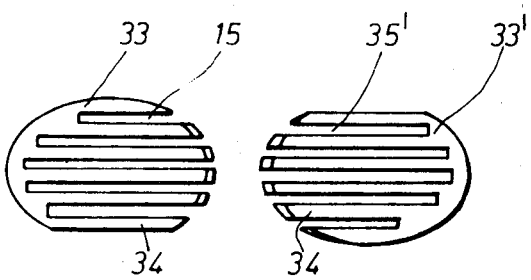
Figure 15:
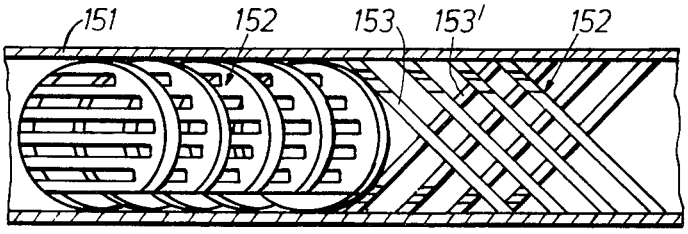

FIG. 15 shows mixing inserts 152 arranged inside the pipe 151. Each mixing insert consists of 5 pairs of plates 153, 153'. The mixing inserts 152 are displaced from these by an angle of 90°. The plates 153, 153' have the form shown in FIG. 3.

Figure 4:
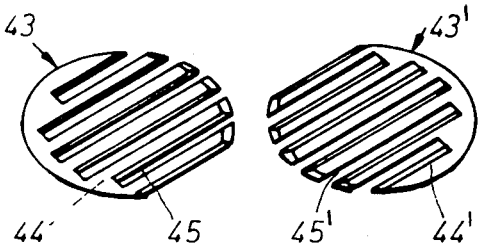
Figure 5:
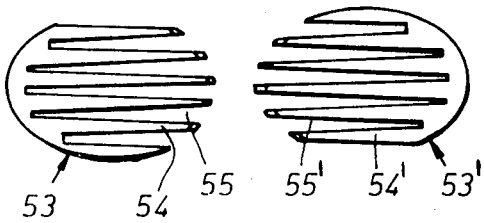
Figure 6:
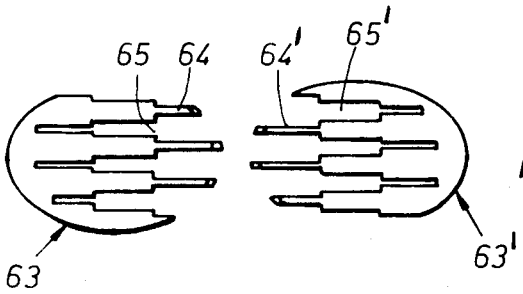
Figure 7:
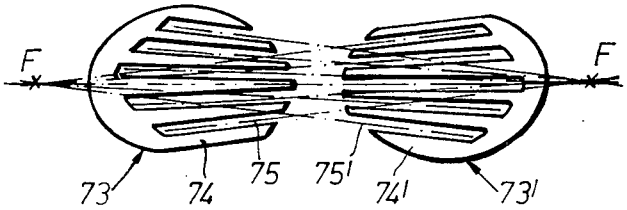
Figure 8:
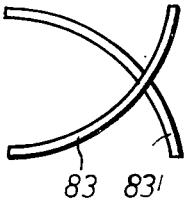
FIG. 8 shows a side view of plates 83, 83' which are curved in two dimensions. They may, of course, also be three-dimensionally curved.
Figure 9:
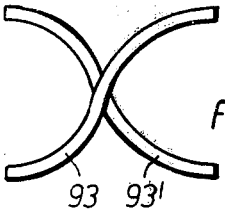
FIG. 9 shows a side view of plates 93, 93' with a double curvature.
Figure 16:
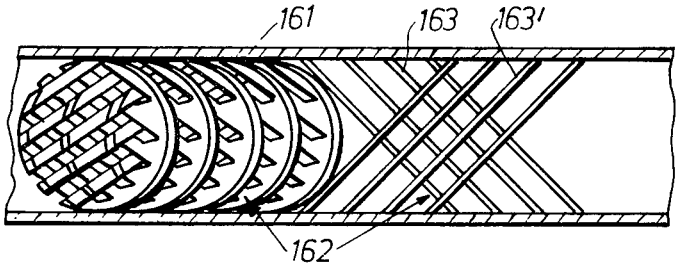

The mixing inserts 162 inside the pipe 161 shown in FIG. 16 are arranged in the same way as in the example illustrated in FIG. 15 but the plates 163, 163' have the same form as in FIG. 4.

Figure 17:
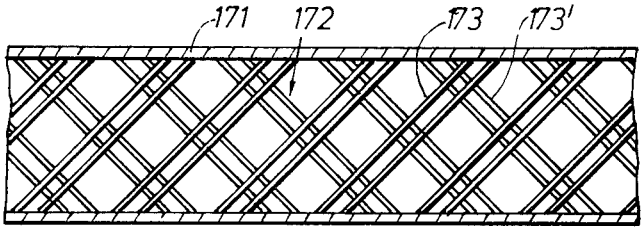

FIG. 17 shows a pipe 171 containing mixing inserts 172 which overlap in the sense that each of the plates 173, 173' extends through several intersection plates. Two plates 173, 173' are in each case arranged close together parallel to each other while the next following two plates are spaced apart from them by about twice the interval.

Figure 18:
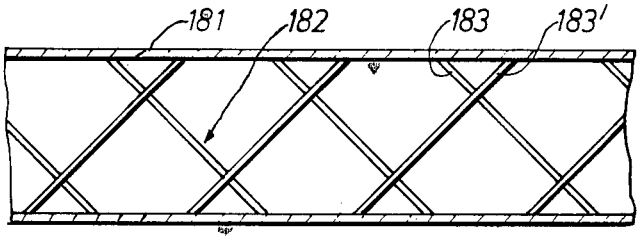

In the embodiment shown in FIG. 18, the pipe 181 contains mixing inserts 182 which are so arranged that the plates 183, 183' also intersect the plates of adjacent mixing inserts 182 as in the example shown in FIG. 17 so that again the individual mixing insert cannot be exactly defined. In this example, importance is attached to the fact that the lines of intersection should lie outside the central axis of the pipe 181.

Figure 19:
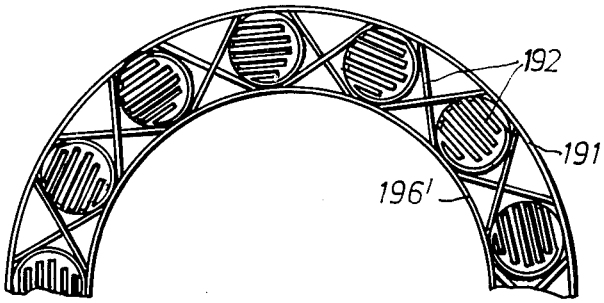

FIG. 19 shows a pipe 191 with a bend 196'. The arrangement and form of the mixing inserts 192 are the same as in FIG. 14.

What we claim is:

1. Apparatus for the static mixing of a fluid stream which comprises a pipe provided with at least one mixing insert comprising at least two plates provided with webs defining slots therebetween, the webs of one plate extending cross-wise through the slots of at least one other plate which is set at an angle to the first plate, said insert being suitable for insertion into the pipe to provide static mixing of the stream of fluid flowing in the pipe, the plates being inclined at an angle to the axis of the pipe, the circumferential surface of each plate fitting snugly against the wall of the pipe.

2. Apparatus as claimed in claim 1 in which the mixing insert comprises several plates, arranged in two rows, the webs of two plates of one row extending through the slots of at least one plate of the other row.

3. Apparatus as claimed in claim 2 in which the plates of each row are arranged parallel to each other.

4. Apparatus as claimed in claim 1 in which there are a plurality of said inserts, and the inserts are disposed so that the plates of adjacent inserts are displaced relative to each other in the circumferential direction.

5. Apparatus as claimed in claim 4, in which the displacement is by an angle of 90°.

6. Apparatus according to claim 4, wherein the plates are elliptical.

7. Apparatus as claim 1 in which the plates are elliptical.

8. Apparatus as claimed in claim 1, wherein the pipe is provided with a plurality of said inserts.

9. Apparatus according to claim 8, wherein the plates are elliptical.

10. Apparatus as claimed in claim 8, wherein the inserts are disposed so that the plates of adjacent inserts are displaced relative to each other in the angular direction by an angle of 90° and the plates of each insert are disposed in the gaps between the plates of the adjacent insert.

11. Apparatus as claimed in claim 10, wherein the plates are elliptical.

12. A mixing insert which comprises at least two plates provided with webs defining slots therebetween, the webs of one plate extending crosswise through the slots of at least one other plate which is set at an angle to the first plate, said insert being suitable for insertion into a pipe to provide static mixing of a stream of fluid flowing in the pipe and wherein the plates are provided with wwbs which taper stepwise.

13. A mixing insert which comprises at least two plates provided with webs defining slots therebetween, the webs of one plate extending crosswise through the slots of at least one other plate which is set at an angle to the first plate, said insert being suitable for insertion into a pipe to provide static mixing of a stream of fluid flowing in the pipe in which the plates are in the form of combs and have elliptical circumferences.

14. A mixing insert which comprises at least two plates in the form of combs provided with webs defining slots therebetween, the webs of one plate extending crosswise through the slots of at least one other plate which is set at an angle to the first plate, said insert being suitable for insertion into a pipe so that each plate makes contact all along its circumference inside of the pipe, and, being effective to provide static mixing of a stream of fluid flowing in the pipe by subdivision of the stream.

15. Apparatus for the static mixing of a fluid stream which comprises a pipe provided with at least one mixing insert as claimed in claim 14, the plates being inclined at an angle to the axis of the pipe, each plate making all around contact with the inside of the pipe.

16. Apparatus as claimed in claim 15 in which the plates are elliptical, and there are a plurality of said inserts disposed in a row extending along the axis of the pipe with the inserts in staggered relation to each other.

17. Apparatus for the static mixing of a fluid stream which comprises a pipe provided with at least one mixing insert which comprises a first group of spaced webs disposed so as to define slots between the webs, and a second group of spaced webs also disposed as to define slots between the webs, the webs of one of said groups extending crosswise through the slots of the other of said groups, said first and second group of webs being mounted in the pipe inclined at an angle to the axis of the pipe for static mixing of a fluid stream passed through the pipe.

* * * * *

UNITED STATES PATENT AND TRADEMARK OFFICE

CERTIFICATE OF CORRECTION

PATENT NO. : 4,062,524

DATED : Dec. 13, 1977

INVENTOR(S) : Dieter Brauner et al

It is certified that error appears in the above-identified patent and that said Letters Patent are hereby corrected as shown below:

Col. 6, line 12 Change "wwbs" to--webs--

Col. 6, line 27 Insert--with the-- after "circumference"

Signed and Sealed this

*Eleventh* Day of *April 1978*

[SEAL]

*Attest:*

RUTH C. MASON
*Attesting Officer*

LUTRELLE F. PARKER
*Acting Commissioner of Patents and Trademarks*